US011963648B2

(12) United States Patent
Duren

(10) Patent No.: US 11,963,648 B2
(45) Date of Patent: Apr. 23, 2024

(54) GROUT CLEANING ATTACHMENT FOR A SHOE

(71) Applicant: Korling Duren, San Antonio, TX (US)

(72) Inventor: Korling Duren, San Antonio, TX (US)

( * ) Notice: Subject to any disclaimer, the term of this patent is extended or adjusted under 35 U.S.C. 154(b) by 0 days.

(21) Appl. No.: 17/736,977

(22) Filed: May 4, 2022

(65) Prior Publication Data

US 2022/0330781 A1 Oct. 20, 2022

Related U.S. Application Data

(63) Continuation of application No. 17/372,491, filed on Jul. 11, 2021, now Pat. No. 11,344,174.

(60) Provisional application No. 63/104,517, filed on Oct. 23, 2020.

(51) Int. Cl.

| | |
|---|---|
| ***A46B 5/04*** | (2006.01) |
| ***A43B 3/16*** | (2022.01) |
| ***A45F 5/02*** | (2006.01) |
| ***A46B 17/02*** | (2006.01) |
| ***A47L 13/06*** | (2006.01) |
| ***A47L 13/18*** | (2006.01) |

(52) U.S. Cl.

CPC ..... *A47L 13/06* (2013.01); *A43B 3/163* (2013.01); *A45F 5/02* (2013.01); *A46B 5/04* (2013.01); *A46B 17/02* (2013.01); *A47L 13/18* (2013.01); *A46B 2200/3033* (2013.01); *A46B 2200/3073* (2013.01)

(58) Field of Classification Search

CPC ..... A47L 13/18; A47L 13/282; A46B 5/04; A46B 17/02; A46B 2200/3073; A43B 3/00; A43B 3/16; A43B 3/20; A43B 3/163

See application file for complete search history.

(56) References Cited

U.S. PATENT DOCUMENTS

| | | | | |
|---|---|---|---|---|
| 3,526,014 | A | 9/1970 | Edwards | |
| 5,173,985 | A | 12/1992 | Palmer | |
| 7,313,842 | B1 | 1/2008 | Preciado | |
| D573,797 | S | 7/2008 | Guillaume | |
| D599,495 | S | 9/2009 | Xiao et al. | |
| 8,458,847 | B2 * | 6/2013 | Herrmann | A43B 5/001 15/176.1 |

(Continued)

FOREIGN PATENT DOCUMENTS

| | | |
|---|---|---|
| WO | 9005478 A1 | 5/1990 |

*Primary Examiner* — Randall E Chin

(74) *Attorney, Agent, or Firm* — Outlier Patent Attorneys, PLLC

(57) ABSTRACT

A grout cleaning attachment configured for removably attaching to a shoe enables a user to scrub a grout line with their foot. The grout cleaning attachment includes a brush that extends out and away from a toe section of the shoe so that a person using the attachment can see where the brush bristles are and locate the brush over the grout line. The grout cleaning attachment includes a cup section that slides over the front section of the shoe and a strap on the aft section that wraps around the person's shoe and ankle to secure the grout cleaning attachment to the shoe. The grout cleaning attachment is light in weight and easy to install and remove from a shoe being worn by a person. The brush is narrow in width and long in length so that most of the bristles will be used to brush over the grout line. Also, the brush can be curved upward in order to improve the brushing performance for cleaning a grout line.

9 Claims, 3 Drawing Sheets

(56) References Cited

U.S. PATENT DOCUMENTS

| | | | | |
|---|---|---|---|---|
| 10,022,033 | B1 | 7/2018 | Maynard | |
| 10,765,197 | B2 | 9/2020 | Peterson | |
| 11,229,282 | B1 * | 1/2022 | Shafer | A43B 1/10 |
| 2006/0265828 | A1 | 11/2006 | Mallatt et al. | |
| 2007/0240330 | A1 | 10/2007 | Beasley | |
| 2014/0338142 | A1 | 11/2014 | Pierce | |

* cited by examiner

GROUT CLEANING ATTACHMENT FOR A SHOE

CROSS-REFERENCE TO RELATED APPLICATIONS

This application is a continuation of U.S. patent application Ser. No. 17/372,491, filed Jul. 11, 2021, now U.S. Pat. No. 11,344,174, entitled GROUT CLEANING ATTACHMENT FOR A SHOE, which claims priority to U.S. Provisional Patent Application Serial No. 63/104,517, filed Oct. 23, 2020, entitled GROUT CLEANING ATTACHMENT FOR A SHOE, the entire contents of which are incorporated herein by reference.

BACKGROUND

Field of Art

This disclosure relates to a device for cleaning grout lines between ceramic tiles, and more specifically to a grout cleaning attachment for a shoe worn by a person.

Background

Ceramic or porcelain tiles are glued to a surface in which a clearance or gap is left between adjacent sides of the tiles. These gaps are later filled in with a grout compound that dries and leaves a rough and hard surface between the tiles. In time, the grout becomes dirty and must be cleaned in order to produce a new-like look.

One typical method of cleaning dirty grout lines is for a person to kneel on a tile floor and scrub the grout lines by hand with a hand-held brush. The force applied to the cleaning brush is mainly due to the person pushing down on the brush.

Another prior art method of cleaning dirty grout lines is a FLOOR WASHING SYSTEM disclosed in U.S. Pat. No. 7,814,605 B1 issued to Tippel on Oct. 19, 2010 which discloses a device that attaches to a bottom surface of a shoe worn by a person that will do the cleaning. The device includes two sections that move together in order to lock onto the underside of the shoe. The bottom side of the device includes a brush that is used to clean a surface. This device is complex in form and cannot be used to clean a surface outside of the surface area beneath the shoe such as a side wall or a corner. Further, while this device may be effective for cleaning an upper surface of a floor, it is not effective for cleaning the grout lines between tiles since the grout lines are typically lower than the upper surface of the rest of the flooring.

SUMMARY

A grout cleaning attachment for a shoe includes a brush that extends out and away from a toe section of a shoe so that a person using the attachment can see where the brush bristles are and locate the brush over the grout line. The grout cleaning attachment includes a cup section that slides over the front section of a shoe and a strap on the aft section that wraps around the person's shoe and ankle to secure the grout cleaning attachment to the shoe. The grout cleaning attachment is light in weight and easy to install and remove from a shoe being worn by a person. The brush is narrow in width and long in length so that most of the bristles will be used to brush over the grout line. Also, the brush may be curved upward in order to improve the brushing performance for cleaning a grout line.

One benefit of the grout cleaning attachment of the present invention is that the brush extends outward from the front of the shoe so that the person using the brush on their shoe can see where the brush is and locate the brush over the grout line. In addition, a person having the grout cleaning attachment coupled to their shoe can still walk comfortably since the brush bristles are not under the shoe.

Another benefit of the grout cleaning attachment of the present invention is that the long but narrow brush that extends out the front of the shoe can easily be used to clean grout lines along a wall or in a corner. The prior art FLOOR WASHING SYSTEM of the Tippel patent described above cannot be used for corners or walls or for reaching into grout lines that may be lower than the upper surface of the flooring tiles.

BRIEF DESCRIPTION OF THE DRAWING FIGURES

The accompanying drawings illustrate several embodiments and, together with the description, serve to explain the principles of the invention according to the embodiments. It will be appreciated by one skilled in the art that the particular arrangements illustrated in the drawings are merely exemplary and are not to be considered as limiting of the scope of the invention or the claims herein in any way.

DETAILED DESCRIPTION OF EMBODIMENTS

Figure 1:
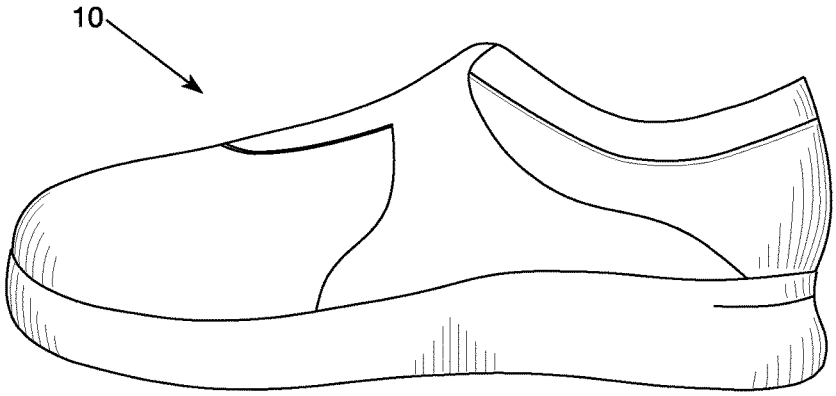
FIG. 1 illustrates a shoe of the prior art to be used with the grout cleaning attachment of the present invention.

The inventor has conceived and reduced to practice an apparatus for cleaning grout lines between tiles. In one embodiment, the apparatus is an attachment that is configured to attach to a shoe of a user. The attachment may include a cup configured to fit around the toe end of a shoe, a handle configured to attach to the bottom surface of the shoe, a tie portion configured to tie around a user's ankle, and a brush extending distally of the cup and the handle.

The invention is described by reference to various elements herein. It should be noted, however, that although the various elements of the inventive apparatus are described separately below, the elements need not necessarily be separate. The various embodiments may be interconnected and may be cut out of a singular block or mold. The variety of different ways of forming an inventive apparatus, in accordance with the disclosure herein, may be varied without departing from the scope of the invention.

Generally, one or more different embodiments may be described in the present application. Further, for one or more of the embodiments described herein, numerous alternative arrangements may be described; it should be appreciated that these are presented for illustrative purposes only and are not limiting of the embodiments contained herein or the claims presented herein in any way. One or more of the arrangements may be widely applicable to numerous embodiments, as may be readily apparent from the disclosure. In general, arrangements are described in sufficient detail to enable those skilled in the art to practice one or more of the embodiments, and it should be appreciated that other arrangements may be utilized and that structural changes may be made without departing from the scope of the embodiments. Particular features of one or more of the embodiments described herein may be described with reference to one or more particular embodiments or figures that form a part of the present disclosure, and in which are shown, by way of illustration, specific arrangements of one or more of the aspects. It should be appreciated, however, that such features are not limited to usage in the one or more particular embodiments or figures with reference to which they are described. The present disclosure is neither a literal description of all arrangements of one or more of the embodiments nor a listing of features of one or more of the embodiments that must be present in all arrangements.

Headings of sections provided in this patent application and the title of this patent application are for convenience only and are not to be taken as limiting the disclosure in any way.

Devices and parts that are connected to each other need not be in continuous connection with each other, unless expressly specified otherwise. In addition, devices and parts that are connected with each other may be connected directly or indirectly through one or more connection means or intermediaries.

A description of an aspect with several components in connection with each other does not imply that all such components are required. To the contrary, a variety of optional components may be described to illustrate a wide variety of possible embodiments and in order to more fully illustrate one or more embodiments. Similarly, although process steps, method steps, or the like may be described in a sequential order, such processes and methods may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the embodiments, and does not imply that the illustrated process is preferred. Also, steps are generally described once per aspect, but this does not mean they must occur once, or that they may only occur once each time a process, or method is carried out or executed. Some steps may be omitted in some embodiments or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments need not include the device itself.

Techniques and mechanisms described or referenced herein will sometimes be described in singular form for clarity. However, it should be appreciated that particular embodiments may include multiple iterations of a technique or multiple instantiations of a mechanism unless noted otherwise. Alternate implementations are included within the scope of various embodiments in which, for example, functions may be executed out of order from that shown or discussed, including substantially concurrently or in reverse order, depending on the functionality involved, as would be understood by those having ordinary skill in the art.

The present invention is for a grout cleaning attachment that can be secured to a shoe. The grout cleaning attachment enables a person who is wearing the shoe to clean grout lines on a floor with ease. For instance, the grout cleaning attachment enables the wearer to clean grout lines on a floor without bending over. Moreover, the way that the attachment is designed enables the wearer to apply pressure on the cleaning surface via the wearer's leg (as opposed to the wearer's arms or back), which enables the application of greater pressure and relieves back, arm, and wrist discomfort that is typically associated with the traditional method of cleaning grout lines on a floor (i.e. by squatting or bending over and brushing the grout with a hand-held brush).

Figure 2A:
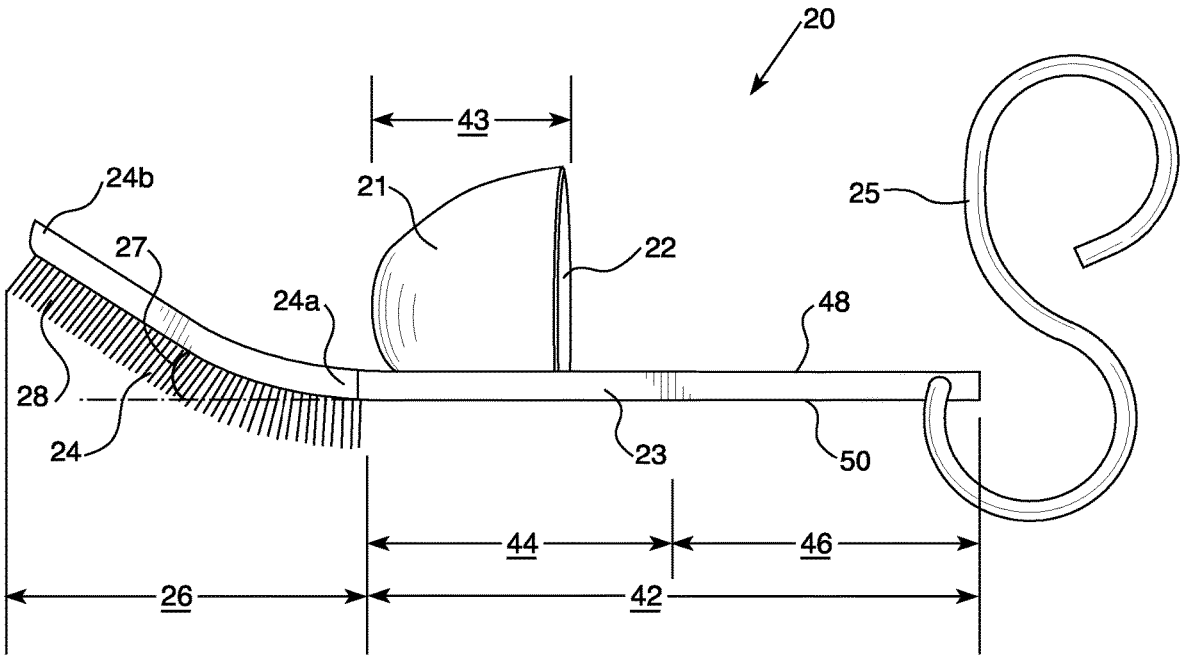
FIG. 2A is a side view of a grout cleaning attachment of the present invention.

FIG. 2A illustrates an exemplary embodiment of the grout cleaning apparatus 20 in accordance with an embodiment of the invention. The grout cleaning attachment 20 to be secured to a shoe 10 (shown in FIG. 1) worn by a person includes a cup section 21 secured to a brush handle 23 of the attachment 20. The brush handle 23 has a length 42 that extends generally from a user's toes to approximately the middle of the user's foot when the attachment 20 is removably coupled to a user's shoe 10. The length 42 may be any desired length, depending on the shoe size of the user. For example, the length 42 of the brush handle 23 may be between 6 and 9 inches, or between 7 and 8 inches. The brush handle 23 includes a forward section 44, an aft section 46, a top side 48, and a bottom side 50. The brush handle 23 is configured to attach directly to the bottom surface of a user's shoe 10 with the top side 48 in direct contact with the bottom surface of the shoe 10. The brush handle 23 is flat so that a user can easily walk and balance with the attachment 20 coupled to their shoe 10. This is advantageous over other devices that may have brush bristles extending from, or attached to, the bottom surface of a shoe.

Figure 3:
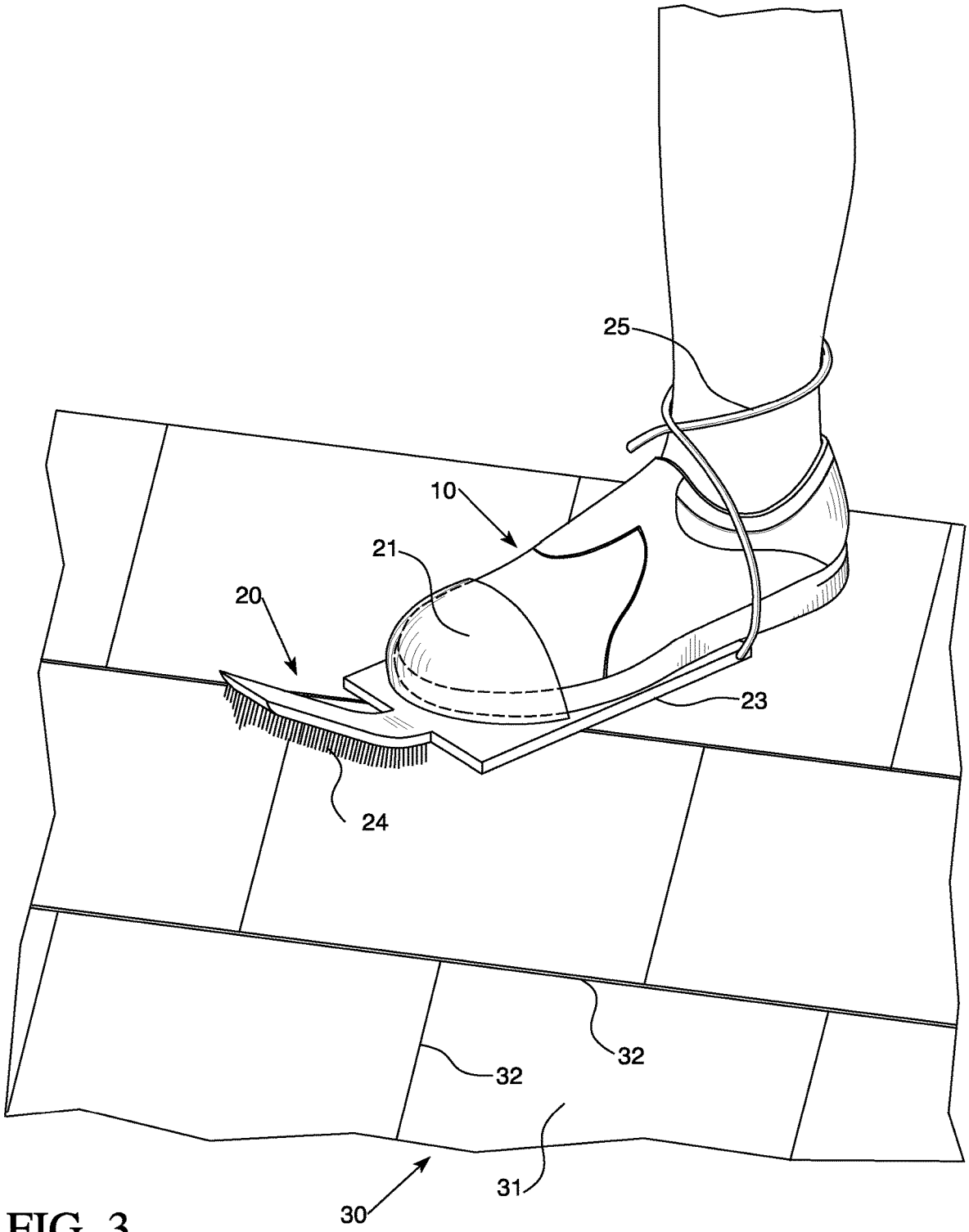
FIG. 3 illustrates the grout cleaning attachment of FIGS. 2A-2C worn on a shoe by a person to clean grout lines on a tile floor.

The cup section 21 is coupled to the top side 48 in the forward section 44 of the brush handle 23. The cup section 21 slides over a front section of a shoe 10 like that shown in FIG. 1 to prevent the attachment 20 from moving with respect to the shoe 10. The cup section 21 has a concave opening 22 that is sized and shaped to accommodate the front section, or toe section, of the shoe 10. During use, as shown in FIG. 3, the toe section of a shoe 10 is disposed within the cup 21. The cup section 21 may have a length 43 of approximately 4 to 6 inches.

The attachment 20 includes a brush 24 extending from a front of the brush handle 23. The brush 24 is used to clean tile grout lines. The brush 24 extends out from the front of the shoe 10 so that the person using the attachment 20 can clearly see the location of the brush 24 over the grout line. For example, the brush 24 may extend distally relative to the handle 23 and the shoe 10 and may have a length 26 of about 4 to 6 inches. The brush 24 may be curved upward in order to improve the brush capability. For example, the angle 27 between the brush 24 and the handle 23 may be about 10 to 45 degrees, and is preferably between 20 and 40 degrees. However, in other embodiments, the brush 24 may be straight and not curved and still be operational in cleaning a grout line.

Figure 2B:
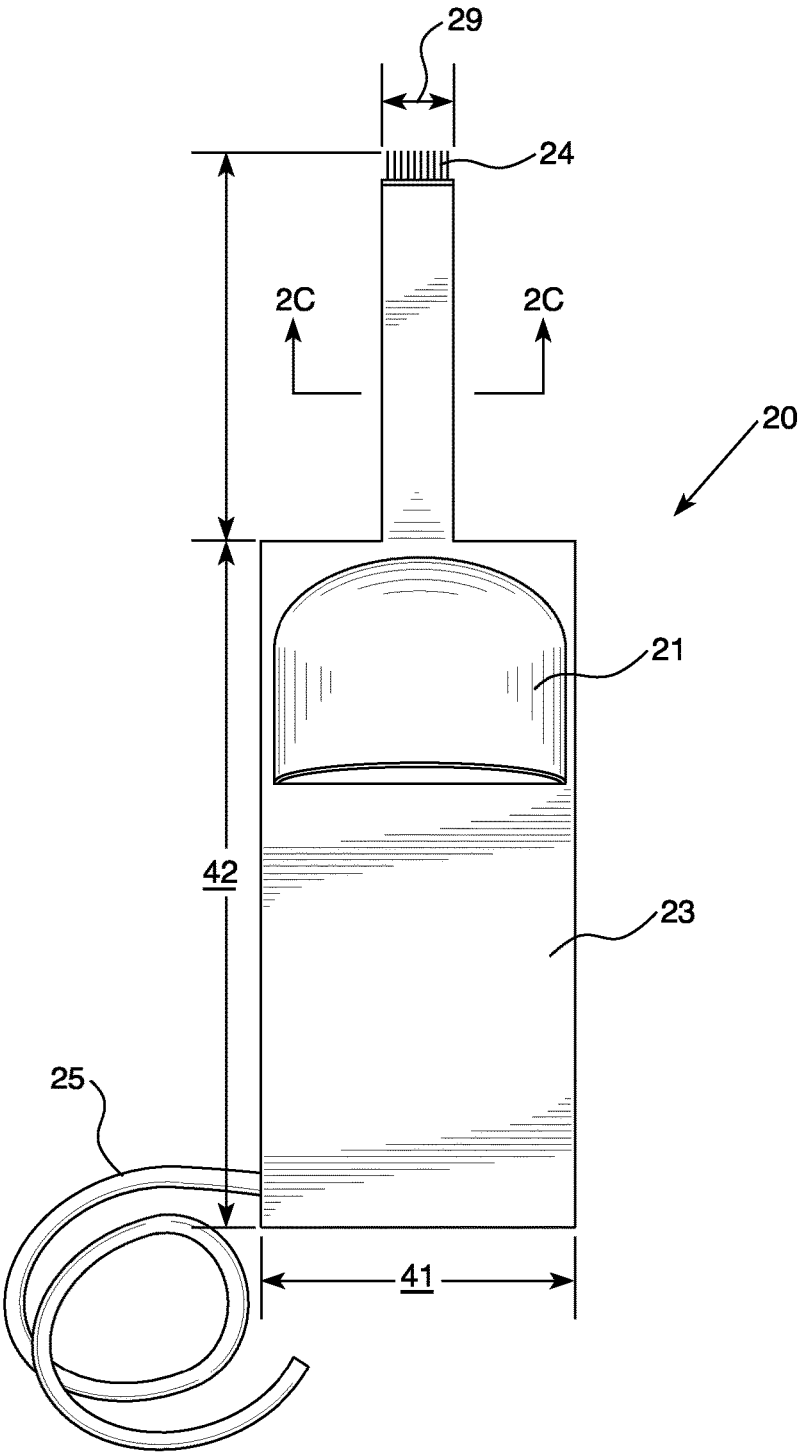
FIG. 2B is a top-down view of the grout cleaning attachment depicted in FIG. 2A in accordance with one aspect of the invention

The brush 24 may be relatively long in length and narrow in width in order to locate most of the bristles 28 of the brush 24 over the grout line and sides of the tile abutting the grout line. In one example, the brush 24 has a length 26 of about 4 to 6 inches and a width 29 of about 0.25 inches to 0.5 inches, as shown in FIG. 2B. This way, most of the force pushing down on the brush 24 will be over the grout line. The bristles 28 of the brush 24 are oriented downward so that the bristles 28 can directly contact the grout lines in a tile floor surface when a user has the attachment 20 removably coupled to their shoe 10.

Figure 2C:
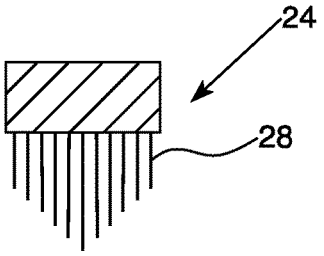
FIG. 2C is a cross-sectional view of the brush taken along line 2C-2C.

As shown in FIG. 2C, the bristles 28 of the brush 24 may have a V-shaped configuration. That is, the bristles 28 along the longitudinal middle of the brush 24 are longer than the bristles 28 along the longitudinal sides of the brush 24. As such, the longer bristles 28 in the middle of the brush 24 can apply more pressure and can more effectively reach into the grout line since the grout line may be lower than the surfaces of the adjacent tiles.

The attachment 20 includes an elongate, flexible strap 25 coupled to the aft section 46 of the brush handle 23. The strap 25 is configured to wrap around the user's heel, ankle, and shoe 10, as shown in FIG. 3. The strap 25 may be secured to the user's ankle by using a strap securing mechanism. For example, the strap securing mechanism may be a tie, a hook and loop fastener, a snap, a button, a magnet, a buckle, or the like. Together, the cup section 21 and the strap 25 will secure the grout cleaning attachment 20 to a shoe 10 worn by a person so that the brush 24 will be stable when used to brush a grout line in a back and forth manner.

One benefit of the grout cleaning attachment 20 of the present invention is that a user can walk over a flooring while the attachment 20 is secured to the user's shoe 10. Since the handle 23 is flat, a user can easily stand and walk with the attachment 20 coupled to their shoe 10.

The grout cleaning attachment 20 of the present invention can be made more stable by forming the brush handle 23 much wider than the brush 24 so that the brush handle 23 will cover as much of the underside of the shoe 10 as possible to prevent the brush section 24 from twisting with respect to the shoe 10. As shown in FIG. 2B, the width 41 of the brush handle 23 is significantly greater than the width 29 of the brush 24. For example, the width 41 of the brush handle 23 may be about 4 to 6 inches, and the width 29 of the brush 24 may be about 0.25 inches to 0.5 inches.

FIG. 3 shows the grout cleaning apparatus 20 of the present invention secured on a shoe 10 worn by a person. A floor 30 formed of ceramic tiles 31 includes an array of grout lines 32 that are to be cleaned by brushing the lines with the attachment 20 of the present invention.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Some embodiments may be described using the expression "coupled" and "connected" along with their derivatives. For example, some embodiments may be described using the term "coupled" to indicate that two or more elements are in direct physical or electrical contact. The term "coupled," however, may also mean that two or more elements are not in direct contact with each other, but yet still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs for a system and a process for creating an interactive message through the disclosed principles herein. Thus, while particular embodiments and applications have been illustrated and described, it is to be understood that the disclosed embodiments are not limited to the precise construction and components disclosed herein. Various apparent modifications, changes and variations may be made in the arrangement, operation and details of the method and apparatus disclosed herein without departing from the spirit and scope defined in the appended claims.

What is claimed is:

1. A cleaning attachment configured for attaching to a shoe of a user, the cleaning attachment comprising:

a brush handle having a distal end, a proximal end, a top side, and a bottom side, wherein, when the cleaning attachment is coupled to the shoe, the top side of the handle is in direct contact with a bottom surface of the shoe and the distal end of the handle is adjacent to a toe end of the shoe, and wherein the brush handle is flat and there are no bristles attached directly to the brush handle;

a concave cup secured to the top side of the brush handle, wherein the cup is sized and shaped to receive the toe end of the shoe, such that the toe end of the shoe is disposed in the cup when the cleaning attachment is coupled to the shoe; and a cleaning brush having a plurality of bristles, a distal end, a proximal end, and a length extending therebetween, wherein the proximal end of the cleaning brush is attached directly to the distal end of the brush handle, wherein, when the cleaning attachment is coupled to the shoe, the distal end of the cleaning brush extends forward of the toe end of the shoe by a distance equal to the length of the cleaning brush, and wherein the plurality of bristles are oriented downward.

2. The cleaning attachment of claim 1, wherein the length of the cleaning brush is 4 to 6 inches, such that, when the cleaning attachment is coupled to the shoe, the distal end of the cleaning brush is positioned 4 to 6 inches away from the toe end of the shoe.

3. The cleaning attachment of claim 1, wherein the cleaning brush has a width less than that of the brush handle.

4. The cleaning attachment of claim 3, wherein the width of the cleaning brush is 0.25 inches to 0.5 inches, and wherein the width of the brush handle is 4 to 6 inches.

5. The cleaning attachment of claim 1, wherein the proximal end of the cleaning brush has a width less than that of the distal end of the brush handle.

6. The cleaning attachment of claim 1, wherein the plurality of bristles are disposed along substantially the entire length of the cleaning brush.

7. The cleaning attachment of claim 1, further comprising a strap coupled to the proximal end of the brush handle, wherein the strap is configured to wrap around an ankle of the user wearing the shoe when the cleaning attachment is coupled to the shoe.

8. A cleaning attachment configured for attaching to a shoe of a user, the cleaning attachment comprising:

a brush handle having a distal end, a proximal end, a top side, and a bottom side, wherein, when the cleaning attachment is coupled to the shoe, the top side of the handle is in direct contact with a bottom surface of the shoe and the distal end of the handle is adjacent to a toe end of the shoe, and wherein the brush handle is flat and there are no bristles attached directly to the brush handle;

a concave cup secured to the top side of the brush handle, wherein the cup is sized and shaped to receive the toe end of the shoe, such that the toe end of the shoe is disposed in the cup when the cleaning attachment is coupled to the shoe; and a cleaning brush having a plurality of bristles, a distal end, a proximal end, and a length extending therebetween, wherein the proximal end of the cleaning brush is attached directly to the distal end of the brush handle, wherein, when the cleaning attachment is coupled to the shoe, the distal end of the cleaning brush extends forward of the toe end of the shoe by a distance equal to the length of the cleaning brush, and wherein the cleaning brush is curved in an upward direction relative to the brush handle.

9. The cleaning attachment of claim 8, wherein an angle between the cleaning brush and the brush handle is 20 to 40 degrees.

* * * * *